United States Patent [19]

Wang

[11] Patent Number: 4,621,623

[45] Date of Patent: Nov. 11, 1986

[54] MULTI-FUNCTION GYMNASTIC DEVICE

[76] Inventor: Leao Wang, No. 59 Mei Ts'un Road, Taichung City, Taiwan

[21] Appl. No.: 694,781

[22] Filed: Jan. 25, 1985

[51] Int. Cl.[4] ..... A63B 69/06; A63B 21/00

[52] U.S. Cl. ..... 128/72; 128/130

[58] Field of Search ..... 272/72, 130, 144, 145, 272/134

[56] References Cited

U.S. PATENT DOCUMENTS

| | | | |
|---|---|---|---|
| 368,111 | 8/1887 | Reach | 272/72 |
| 1,727,657 | 9/1929 | Martin | 272/72 |
| 3,473,843 | 10/1969 | Hart | 272/72 |
| 3,614,097 | 10/1971 | Blickman | 272/72 |
| 4,235,437 | 11/1980 | Ruis et al. | 272/130 X |
| 4,477,071 | 10/1984 | Brown et al. | 272/72 |

FOREIGN PATENT DOCUMENTS

| | | | |
|---|---|---|---|
| 2309253 | 11/1976 | France | 272/72 |
| 2480608 | 10/1981 | France | 272/72 |
| 2511879 | 3/1982 | France | 272/72 |
| 0150501 | 9/1920 | United Kingdom | 272/72 |

*Primary Examiner*—Robert A. Hafer
*Assistant Examiner*—Kathleen D'Arrigo

[57] ABSTRACT

A multi-function gymnastic device which is composed of a pedestal capable of being erected and two rocker components installed on the two sides of said pedestal and capable of being assembled horizontally when the said pedestal is in an erect state so that the said rocker components can be pushed and pulled to-and-fro for boat-rowing sports, up-and-down for weight-lifting sports, and left-and-right for chest-expanding sports, and moved for 360° so as to be in keeping with each other to change the mode of sports and to achieve the effect of multi-function sports.

1 Claim, 4 Drawing Figures

MULTI-FUNCTION GYMNASTIC DEVICE

BACKGROUND OF THE INVENTION

The function of every conventional gymnastic device is limited to only a single effect of sports. For example, the boat-rowing gymnastic device generates only an effect of boat-rowing sports. In onther words, the rocker of conventional boat-rowing gymnastic device can only be pushed and pulled to-and-fro, so its scope of sports is rather insufficient and this is its well-known drawback.

SUMMARY OF THE INVENTION

This invention is designed to eliminate the above-said drawback of conventional gymnastic devices and to offer a multi-function gymnastic device which is developed by this inventor through his consecutive research, design and improvement of practice and experience in gymnastic equipment for a number of years and characterized by capable of erecting the said pedestal with the rocker components on two sides to be in a vertical state so that the rocker components can can be pushed and pulled up-and-down for weight-lifting sports and to-and-fro for boat-rowing sports and easily assembled horizontally to be pushed and pulled left-and-right for chest-expanding sports in order to achieve the multi-function purpose.

The function and characteristics of this invention consist in novel structure wherein the configuration of pedestal and rocker can be easily changed to be pushed and pulled to-and-fro, left-and right and up-and-down for a plurality of sports so as to achieve the multi-function purpose of sports.

DETAILED DESCRIPTION OF THE PREFERRED EMBODIMENT

A bearer bar(12) on the bearer head(11) at the front end of bearer(1) is designed to assemble the movable shoe(13), two lugs(14) on the bearer head(11) are used to assemble the pedestal(2), and a movable cushion(41) as a seat is mounted on the cushion support(4) at the rear end of bearer(1) for performing sports.

The foregoing pedestal(2) consists of an oblong pipe(21) with mutually vertically fixed round pipes(22) at two ends, and two bearer pipes(23) with pivotally-connected pipe(24) at two ends. The pedestal(2) is assembled on the bearer(1) by making use of a shaft lever(25) penetrating the bearer(1) and pivotally connecting the pivotally-connected pipe(24) to the position between the two lugs(14) on the bearer head(11) so that the whole pedestal(2) together with the two rocker components(3) on two sides can be erected in a vertical state.

Figure 2:
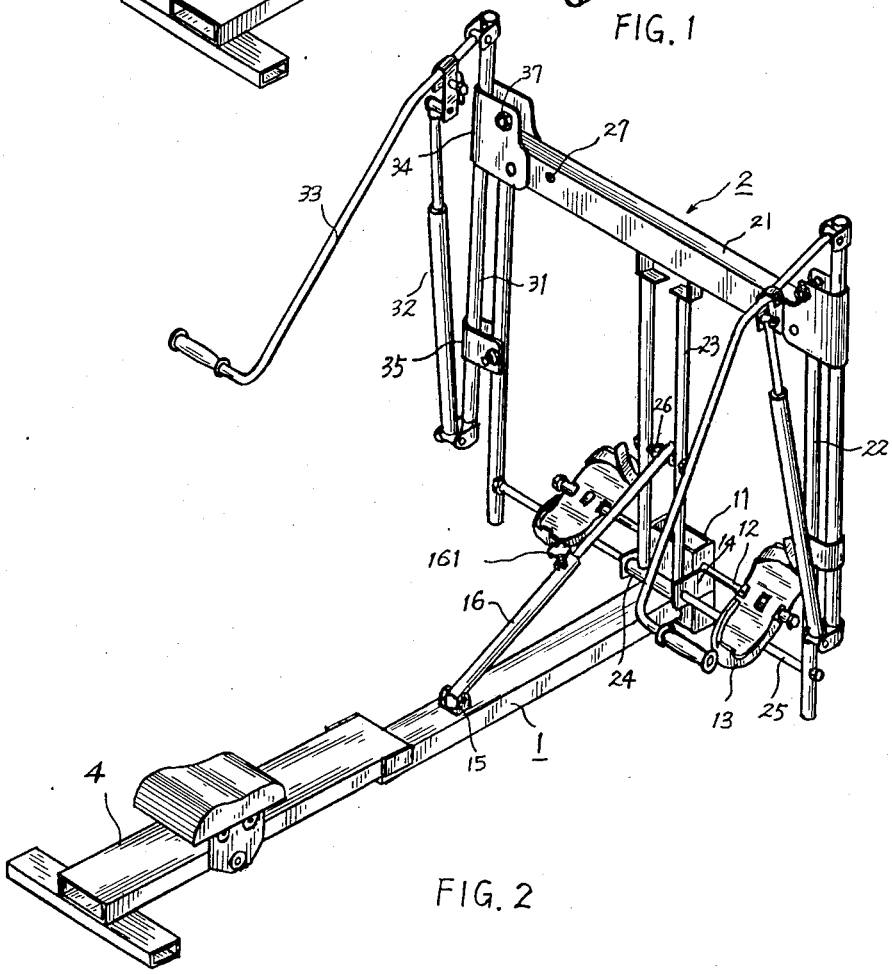
FIG. 2 is an elevation view of this invention with the pedestal in an erect or vertical state.

A support rod(23) is mounted between the foregoing two bearer pipes(23), an assembly lug(15) on the bearer(1) is in keeping with the said support rod(26), and an expansion pipe for support is connected to both assembly lug(15) and support rod(26) so that the pedestal(2) erected can be supported and fixed as shown in FIG. 2.

Figure 3:
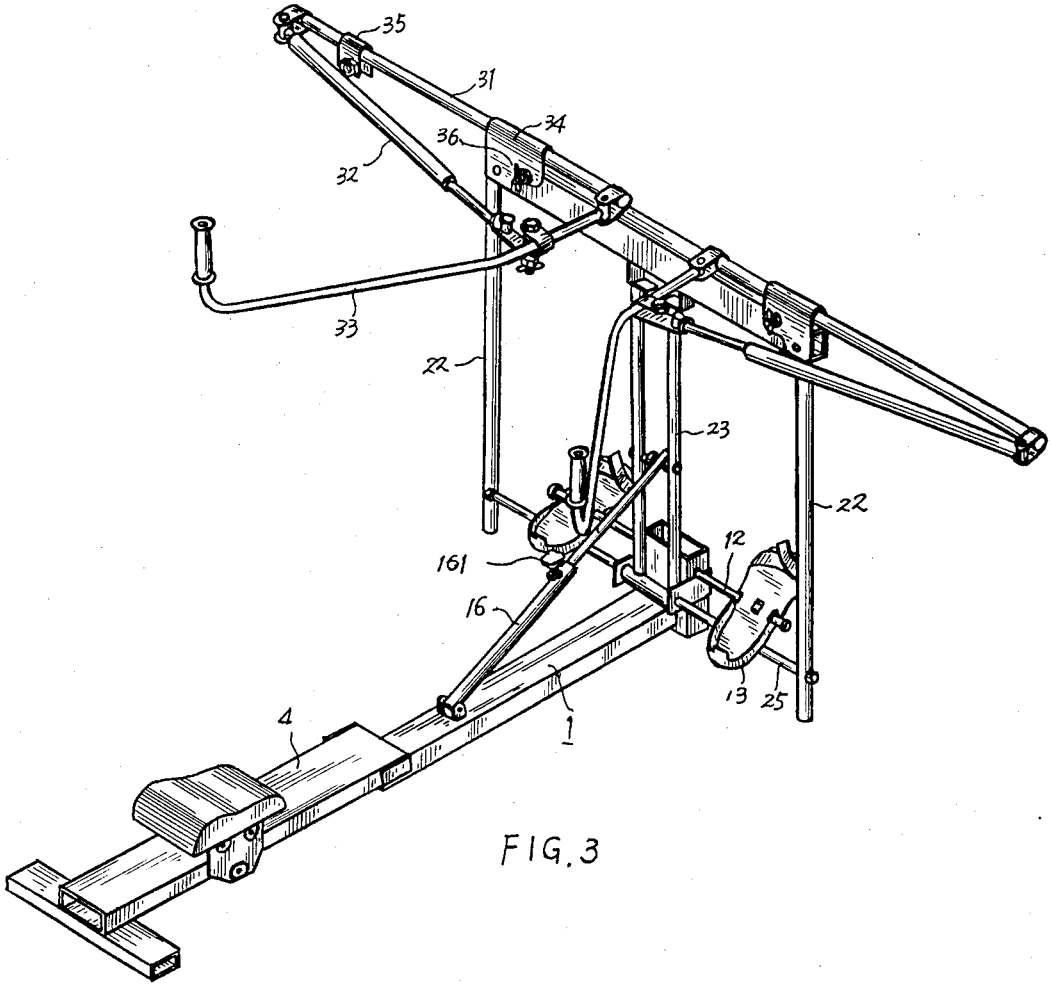
FIG. 3 is an elevation view of this invention with the rocker components in a horizontal assembly state.
Figure 4:
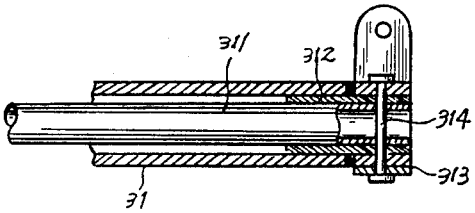
FIG. 4 shows the assembly of joint of rocker component of this invention.

The foregoing rocker component(3) consists of a shaft pipe(31), a hydraulic expansion pipe(32) and a rocker(33). Two U-assembly members(34), (35) are welded on the shaft pipe(31), the U-assembly member(34) is pivotally connected to the end of oblong pipe(21), and the U-assembly member(35)/is welded with a threaded assembly hole so that a screw (36)/can be used to prnetrate and assemble the round pipe(22) of pedestal(2). The U-assembly member(34) is welded with a threaded assembly hole(37) as an alternate assembly hole in keeping with the assembly hole(27) on the oblong pipe(21) of the pedestal(2) so that when the pedestal(2) is erected in a vertical state, the screw(36) can be removed to make the shaft pipe(31) in a horizontal state and the removed screw(36) can be used to assemble both assembly holes(37), (27) as shown in FIG. 3.

Figure 1:
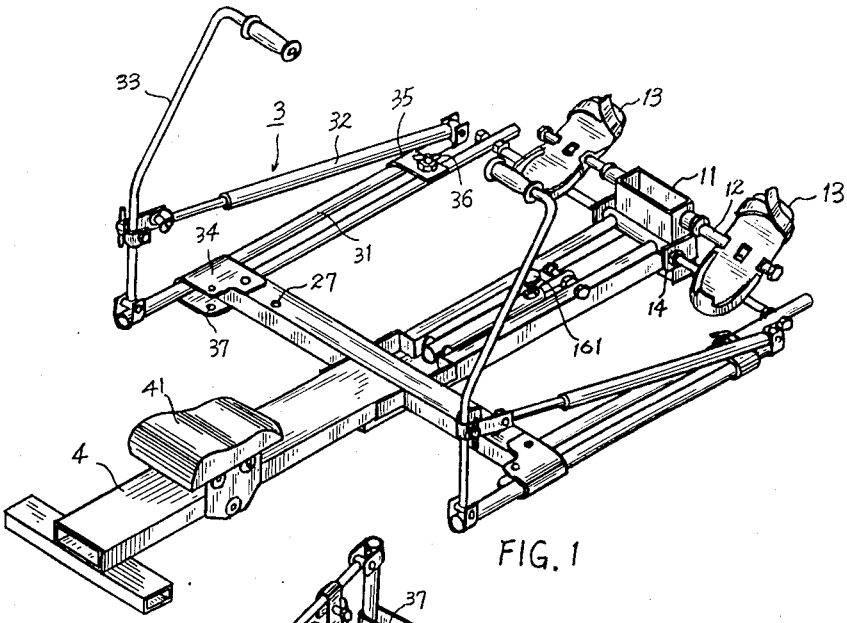
FIG. 1 is an elevation view of this invention.

The terminal assembly structure of said hydraulic expansion pipe(32) and shaft pipe(31) of rocker component(3) is the same as that of rocker(33) and shaft pipe(31) and consists of these members: an inner tube(311) longer/than the shaft pipe(31) is inside the shaft pipe(31), a plastic bushing(312) is mounted between the inner wall of shaft pipe(31) and the outer wall of inner tube(311) at the two ends of inner tube(311), and a joint(313) on the outer wall of said bushing(312) is welded with a short pipe and a U-lug and penetrated and assembled at the end of inner tube(311) by means of an assembly screw(314), so that the rocker(33) and hydraulic expansion pipe(32) can be pivotally connected to the lug of joint(313) respectively and move co-axially for 360° in respect of said inner tube(311), the rocker(33) can change its own position as a result of erecting the pedestal(2) and making the shaft pipe(31) horizontal, and a plurality of functions of sports can be achieved in keeping with the linear motion of rocker(33) given by the hydraulic expansion pipe(32). In other words, to operate this invention, the user sits on the cushion(41) and holds the handles of rocker(33) with his or her two hands for the following actions:

In case this invention is operated in a state as shown in FIG. 1, the rocker(33) can be pushed and pulled to-and-fro for boat-rowing sports.

In case this invention is operated in a state as shown in FIG. 2, the rocker(33) can be pushed and pulled up-and-down for weight-lifting sports.

In case this invention is operated in a state as shown in FIG. 3, the rocker(33) can be pushed and pulled left-and-right for chest-expanding sports.

The foregoing push and pull to-and-fro, up-and-down and left-and-right are linear motions but the motion mode can be changed at any motion point in keeping with the 360° circumferential motion of shaft pipe joint(313) so as to achieve the purpose of multi-function of this invention, enlarge the scope of sports and enhance the momentum of sports.

What is claimed is:

1. A physical exercising apparatus comprising:

a longitudinal ground-engaging base near one end of which a user seat is secured at a preselected position;

a substantially rectangular frame pivotably connected to the another end of the longitudinal base such that the frame can either be closed against the base into a first position in which the frame is substantially coplanar with the base or be opened into a second position in which the frame is supported erect and substantially perpendicular to the base; and a pair of resistance assemblies, each comprising an elongated supporting member adapted to be coupled onto the frame, a pivoted movable lever being connected to one end of the support member and having a handle adapted to be grasped and moved by a user, and a resistance means coupled to the lever and the support member for providing resistance to movement of the lever; the lever being pivotably connected to the support member in such a manner that the lever can be rotated around the axis of the support member in addition to the pivotal movement with respect to the support member, the resistance means being coupled to the support member in such a manner that the resistance means can be rotated around the axis of the support member together with the lever; whereby the orientation of the frame and the handles as well as the levers can be readily arranged for various predetermined modes of exercises.

* * * * *